US005402731A

United States Patent [19]

Miller

[11] Patent Number: 5,402,731

[45] Date of Patent: Apr. 4, 1995

[54] ACTUATOR ASSEMBLY

[75] Inventor: Daniel L. Miller, Bloomdale, Ohio

[73] Assignee: Difco, Inc., Findlay, Ohio

[21] Appl. No.: 101,367

[22] Filed: Aug. 2, 1993

[51] Int. Cl.[6] ..... B61D 7/00

[52] U.S. Cl. ..... 105/286; 105/282.1; 222/504; 222/561

[58] Field of Search ..... 105/286, 280, 282.1, 105/282.2; 222/310, 504, 509, 561

[56] References Cited

U.S. PATENT DOCUMENTS 3,838,649 10/1974 Barnard ..... 105/282.1
4,359,176 11/1982 Johnson ..... 105/282.1
4,454,822 6/1984 Fischer ..... 105/282.1
5,038,966 8/1991 Olk ..... 105/286
5,086,709 2/1992 Fischer et al. ..... 105/286

*Primary Examiner*—Mark T. Le
*Attorney, Agent, or Firm*—Marshall & Melhorn

[57] ABSTRACT

An actuator for a railway car gate assembly unit of the type having doors slidably carried by door guides provided in the gate assembly unit. Pressure fluid actuated motors are coupled between the doors and fixed points on the railway car for effecting sliding movement of the doors.

16 Claims, 4 Drawing Sheets

ACTUATOR ASSEMBLY

BACKGROUND OF THE INVENTION

1. Field of the Invention

The present invention relates to actuator assemblies and, more particularly, to an actuator assembly for operation of sliding doors to open and close the outlet apertures of the railway car employed to deliver ballast material to the track bed of a railway track.

2. Description of the Prior Art

U.S. Pat. No. 5,163,372 issued Nov. 17, 1992 to Galvan et al. shows an actuator assembly for operation of sliding doors of the type disclosed in U.S. Pat. No. 4,454,822 issued Jun. 19, 1984 to Fischer.

The Galvan et al. actuator includes a first and second torque transfer lever means, a pivot arm, a pressure fluid actuated motor, a means for carrying the motor, and means for immobilizing the first and second torque transfer means. The addition of such a number of accessories to the existing Fischer construction adds substantial weight and complexity to the existing device. Addition of such accessories is also expensive and durability has not been established. Thus, those experienced in the art of rail car actuator means have continued to search for a solution to the problem of automating existing gate assembly units.

SUMMARY OF THE INVENTION

An actuator assembly for a gate unit of the type having an inner and an outer plate-like door slidably carried by inner and outer door guides in the unit is provided. The actuator assembly includes a pair of pressure fluid cylinders connected between upper cylinder pivot pins carried on brackets attached to the slidable plate-like doors, and lower pivot pins attached to a lower cylinder mounting bracket attached to the gate assembly.

One of the objects of the present invention is to provide an actuator assembly for an existing gate unit which is of a less complex nature than prior art devices.

A further object of the present invention is to provide an actuator assembly for an existing gate unit lighter in weight than those heretofore known.

Another object of the present invention is to provide an actuator assembly for selective operation of the sliding plate-like doors of gate units.

Still another object of the present invention is to provide an actuator assembly for gate units having sliding plate-like doors which is of simple and practical construction.

A further object of the present invention is to provide a rail car having gate units with sliding plate-like doors which are actuated by pressure fluid actuated motors.

The objects and advantages of the invention are typically achieved in a railway car having a hopper body with an associated hopper bottom outlet and closure means to open and close the outlet wherein the closure means include a door, means for guiding the travel of the door between open and closed positions relative to the outlet; and pressure fluid motor means coupled to said door for selectively effecting motion of the door within the guide means between open and closed positions.

BRIEF DESCRIPTION OF THE DRAWINGS

Further objects and advantages of the invention will be apparent from the following description and appended claims, reference being made to the accompanying drawings forming a part of the specification, wherein like reference characters designate corresponding parts in the several views.

It is to be understood that the present invention is not limited in its application to the details of construction and arrangement of parts illustrated in the accompanying drawings, since the invention is capable of other embodiments and of being practiced or carried out in various ways within the scope of the claims. Also, it is to be understood that the phraseology and terminology employed herein is for the purpose of description, and not of limitation.

DESCRIPTION OF THE PREFERRED EMBODIMENTS

Figure 1:
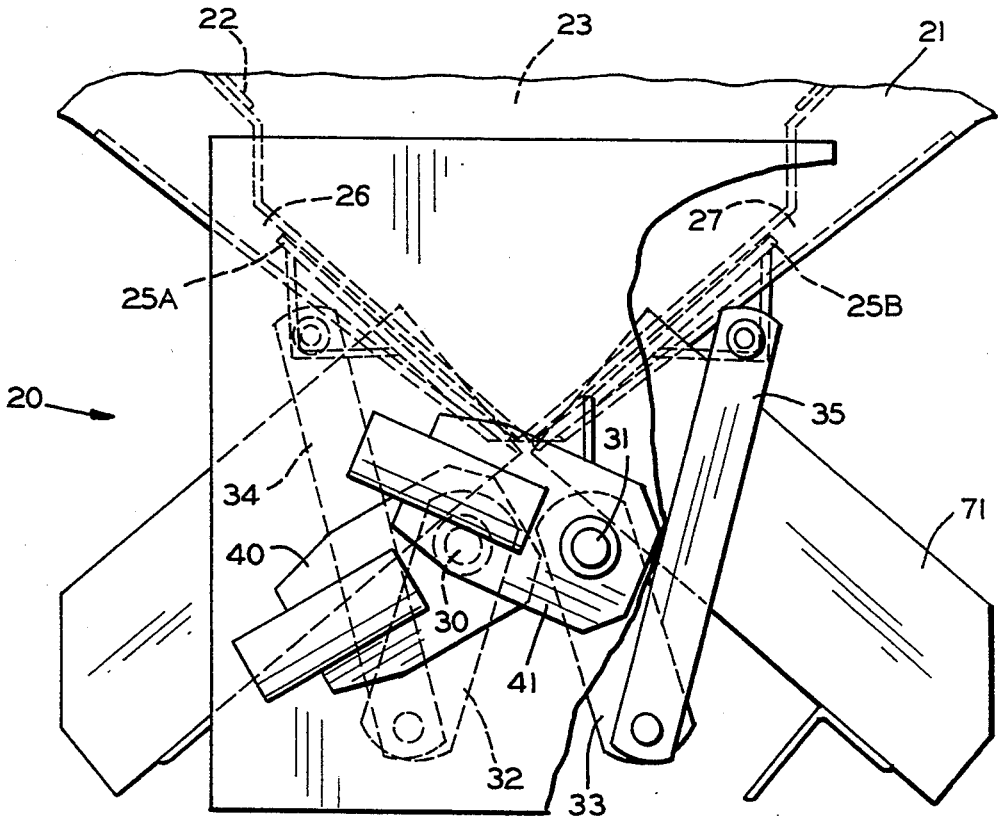
FIG. 1 PRIOR ART
FIG. 1 is an end elevational view, partially cut away, of a gate unit having sliding plate-like doors.

Referring to FIG. 1, there is shown prior art self-contained gate unit 20 of the type disclosed in U.S. Pat. No. 4,454,822. The gate unit is designed for the distribution of ballast material from the interior of a railway car to the road bed below. To facilitate the gravity unloading of the contents of the railway car, the car bottom 21 is formed in part by sheets 22 which slope downwardly and terminate at lower outlets 23. A railway car body may be typically formed with four outlets 23, two of such outlets aligned with one rail, and the other two outlets aligned with the other rail. A gate unit 20 is provided for each of the outlets 23. Each gate unit 20 includes a pair of sliding doors 25A, 25B adapted to slide in respective downwardly converging door guides 26, 27 formed in the units. The doors 25A and 25B are actuated by door shafts 30 and 31, pivot arms 32 and 33, and arms 34 and 35, respectively.

Clockwise rotation of the shaft 30 by the associated bar holder 40 will cause the door 25A to slide upwardly. Counter clockwise rotation of the bar holder 41 will cause the door 25B to slide upwardly. Rotation of the bar holders 40, 41 in the opposite directions will cause the doors to close.

Figure 2:
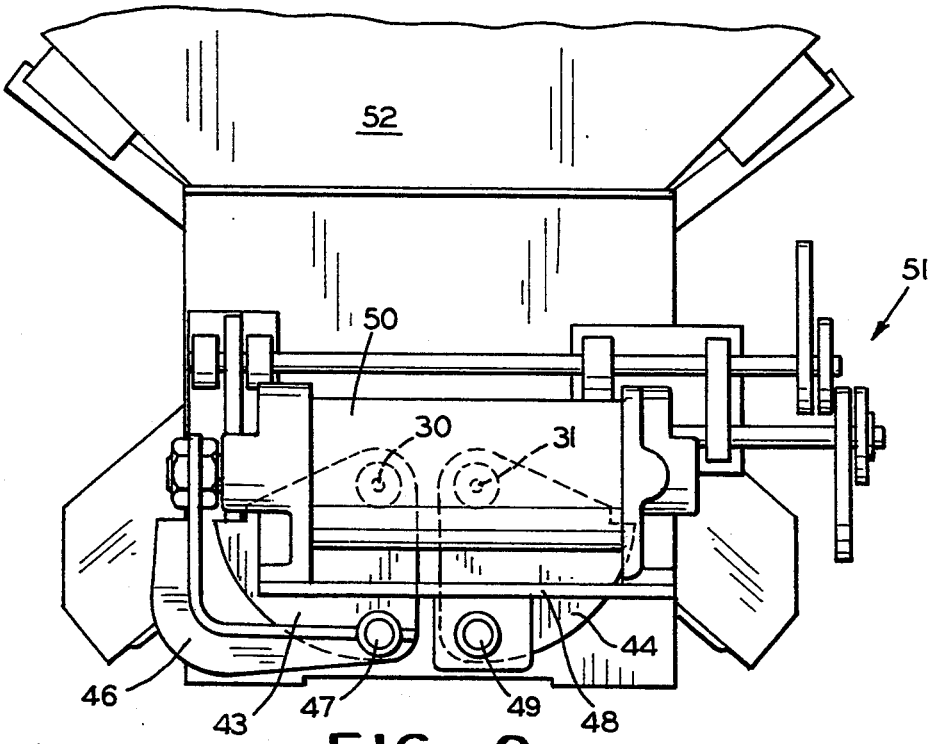
FIG. 2 PRIOR ART
FIG. 2 is end elevational view of a prior art means for actuating the gate unit shown in FIG. 1.
Figure 3:
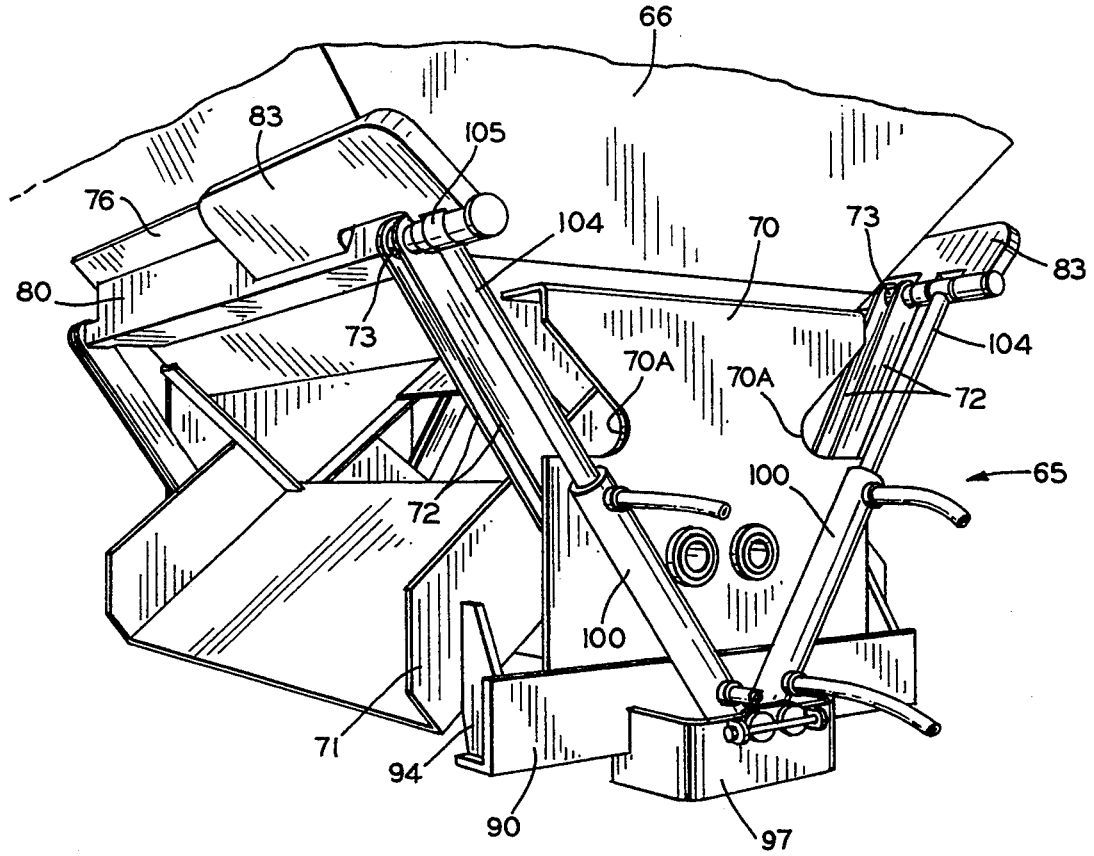
FIG. 3 is a perspective view of a gate assembly embodying the present invention.
Figure 4:
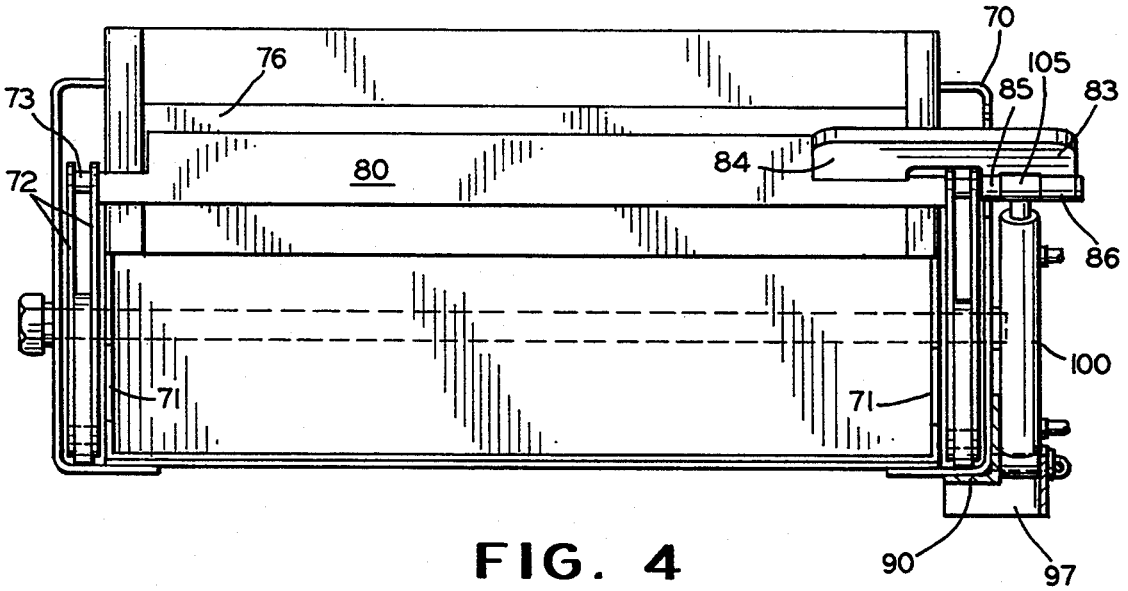
FIG. 4 is a side elevational view of the construction shown in FIG. 3.
Figure 5:
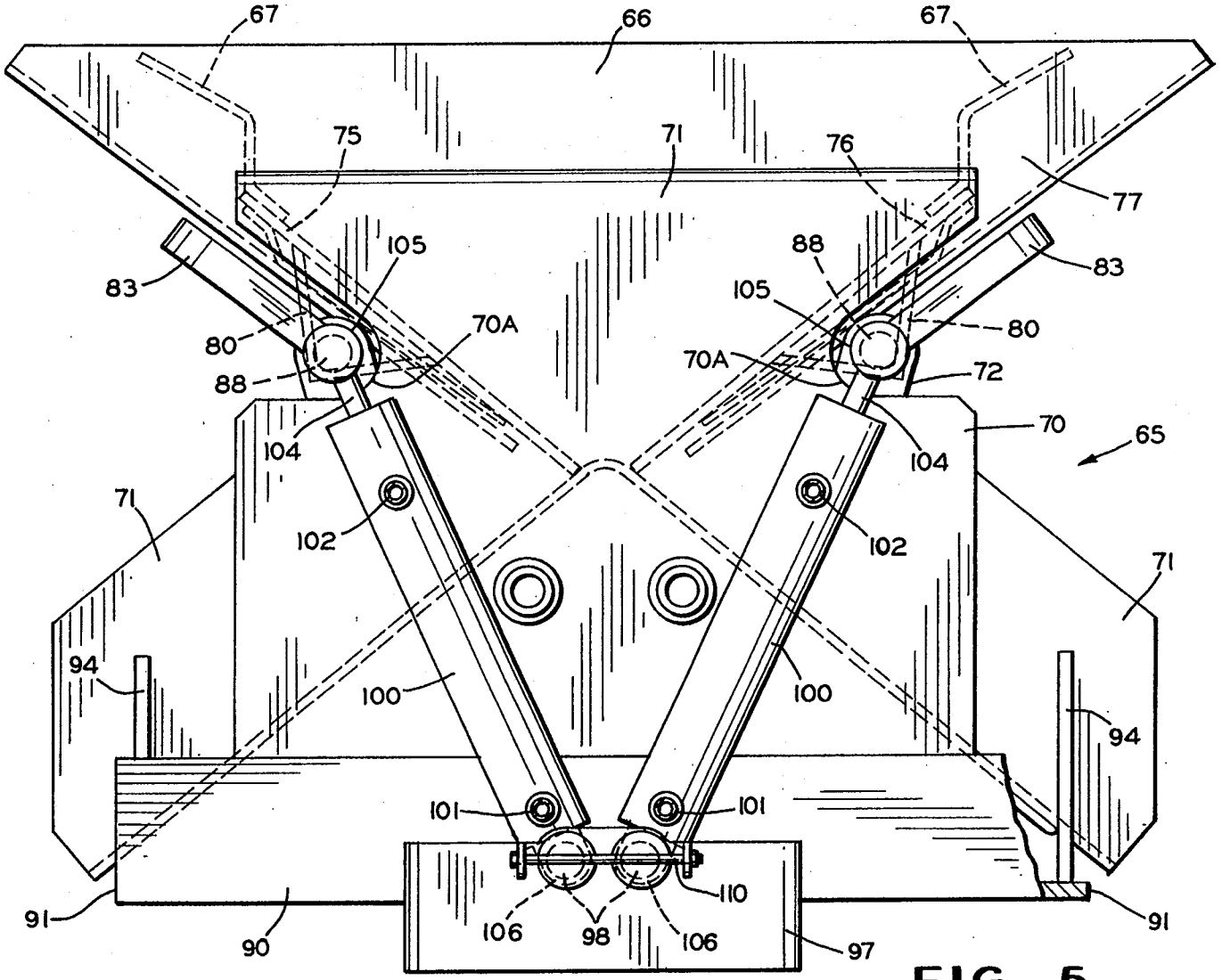
FIG. 5 is an end elevational view of the construction shown in FIGS. 3 and 4.
Figure 6:
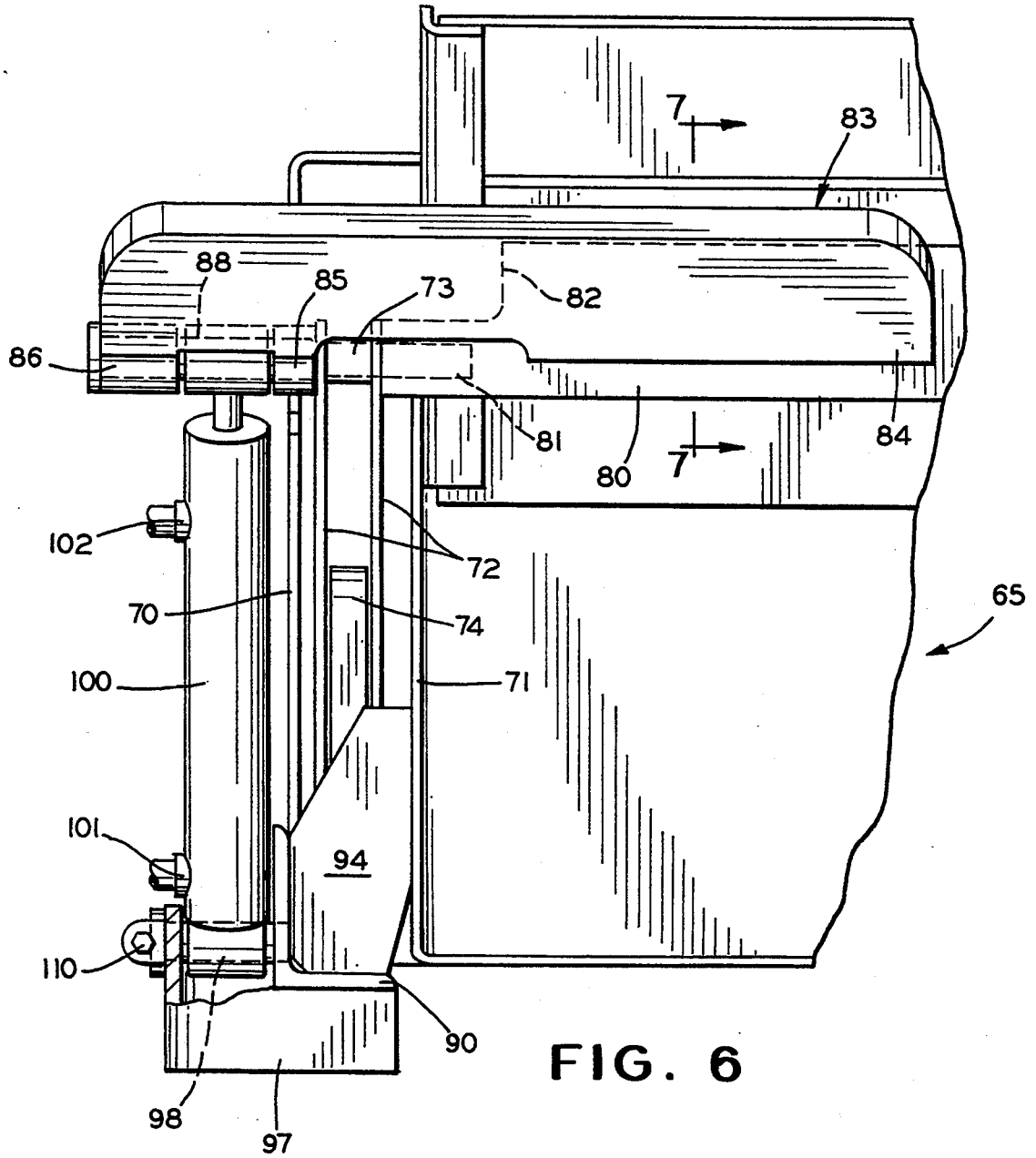
FIG. 6 is a partial elevational view, viewed from the right hand side of the construction illustrated in FIG. 5.

A means of automating or actuating the existing gate unit shown in FIG. 1 is disclosed in U.S. Pat. No. 5,163,372 to Galvan et al. An end elevational view of such a device is shown in FIG. 2. The bar holders 40, 41 shown in FIG. 1 are removed, and are replaced by first and second torque transfer lever means 43, 44 respectively. A pivot arm 46 is attached to the torque transfer lever means 43 by way of connector 47. A motor carrier means 48 is attached to the second torque transfer lever means 44 by means of second connector 49. Upon actuation of the pressure fluid operated motor 50, while one or the other of the first torque transfer lever means or second torque transfer lever means 43, 44, is held in place by gate lock means 51, will cause the inner or outer door shaft 30, 31 to selectively rotate.

The construction of the present invention will now be described with reference to FIGS. 3–7. For ease of understanding, even though some parts are identical with the prior art gate units described above, new identifying numerals will be used.

There is shown a gate unit, generally indicated by the numeral 65, attached to car bottom 66. Part of car bottom 66 is formed by the sheets 67. Shown are the existing end panels 70 and the vertical end flanges 71. Portions 70A of the existing end panels 70 are cut away. Also shown are the existing outer arms 72, spacer 73 and toggle arm 74. An outer ballast door 76 is mounted for relative sliding movement in an outer door guide 77.

Figure 7:
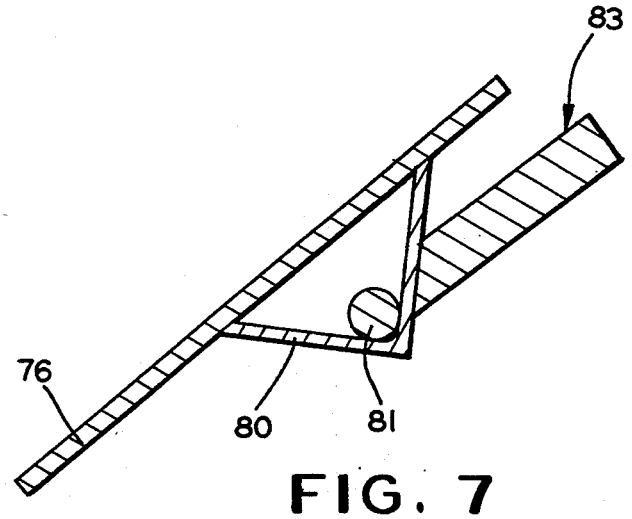
FIG. 7 is a sectional view, taken in the direction of the arrows, along the section line 7—7 of FIG. 6.

Referring to FIG. 7, it can be seen that the ballast door 76 has an angle 80 welded thereto. The angle 80 carries a pivot rod 81 extending therefrom. The ends 82 of the angle 80 are notched to provide clearance for the door guide 77. A similar existing construction would be used on the inner door 75.

An upper cylinder mounting bracket 83 having a mounting portion 86, a first bearing portion 85, and a second bearing portion 84 is connected to each angle 80. The upper cylinder mounting bracket 83 can be attached by any means known in the art which will give the cylinder mounting bracket sufficient strength to repeatedly cycle the doors 75, 76 up and down without fracturing by fatigue. The first bearing portion 85 and the second bearing portion 84 are coaxial and carry an upper pivot pin 88. The upper pivot pin 88 may be coaxial with the pivot rod 81, but does not need to be.

A reinforcing bracket 90 is mounted to the bottom edge of the end panel 70. The ends 91 of the reinforcing bracket 90 extend past the ends of the end panel 70 to allow a pair of parallel spaced gusset plates 94 to be connected or fastened by any suitable means between the reinforcing bracket 90 and the vertical end flanges 71 of the gate assembly unit 65.

A lower cylinder mounting bracket 97, having a pair of spaced apart lower cylinder mounting pins 98, is connected proximate the midpoint to the reinforcing bracket 90. In the preferred embodiment, the lower cylinder mounting pins 98 are symmetrically spaced on the lower cylinder mounting bracket 97. Depending upon the particular application, the pins may be mounted symmetrically or spaced apart in a non-symmetrical relationship.

Between each upper cylinder pivot pin 88 and lower cylinder pivot pin 98 is mounted a double-acting pressure fluid actuated motor 100 having an inlet 101 and an outlet 102. Each motor 100 includes a shaft 104 connected to a piston (not shown) at one end and terminating in a shaft sleeve 105 at the other end, which is connected to upper pivot pin 88. While, in the preferred embodiment, a pressure fluid motor having double acting cylinders 100 are shown, depending on the particular application, other type cylinders may be used.

A sleeve 106 suitably attached to the bottom of the double-acting cylinder 100 is mounted over lower cylinder pivot pin 98. After both double-acting cylinders 100 are so mounted, a retaining means 110 is placed in position to prevent dislodgement of the sleeves 106 from the lower cylinder pivot pins 98.

Any existing pressure fluid system and control means may be used to selectively activate one or the other of cylinders 100 and thus, selectively activate inner door 75 or outer door 76, without the need for the prior art gate locking means 51 shown in FIG. 2.

While the system has been found to operate very satisfactorily utilizing a hydraulic system, it will be understood that a pneumatic system could also be utilized.

Thus, by carefully studying the problems of actuating gate units of the type having an inner and an outer plate-like door slidably carried by inner and outer door guides provided in the gate unit, a novel pressure fluid actuator is provided.

What is claimed is:

1. In a railway car having hopper body with an associated hopper bottom outlet positioned between a pair of opposed end panels, and closure means to open and close the outlet, the closure means including:

a) a door;

b) means for guiding the travel of said door between open and closed positions relative to the outlet; and c) pressure fluid motor means coupled to said door and to one of said end panels for selectively effecting motion of said door within said guide means between open and closed positions.

2. The invention defined in claim 1, wherein said pressure fluid motor means includes:

a) an upper mounting bracket secured to said door;

b) a lower mounting bracket secured to one of said end panels; and c) means for pivotally interconnecting said pressure fluid motor means between said upper and lower mounting brackets.

3. The invention defined in claim 2, wherein said upper mounting bracket is disposed parallel to and proximate the upper edge of said door.

4. The invention defined in claim 3, wherein the axes of said upper mounting bracket, said door, and said means for pivotally interconnecting are parallel.

5. The invention defined in claim 4, wherein said pressure fluid motor means is double-acting.

6. A method for converting a gate assembly unit having a body defined by spaced inner and outer side walls joined by end walls, and having manually operable inner and outer plate-like doors slidably carried in inner and outer door guides formed by portions of the sidewalls and end walls of said gate assembly, including following steps:

(a) providing an upper cylinder mounting bracket for attaching to each of said plate-like doors, (b) providing an upper cylinder pivot pin for attaching to each of said upper cylinder mounting brackets, (c) providing a lower cylinder mounting bracket for attaching to said gate assembly, proximate the lower end of one of the end walls, (d) providing a pair of symmetrically spaced lower cylinder pivot pins for attaching to said lower cylinder mounting bracket, and (e) providing a pair of pressure fluid actuated cylinders each for attaching between one of said upper cylinder pivot pins and one of said lower cylinder pivot pins.

7. The method defined in claim 6, and further including:

(a) providing a pair of gussets for attaching to said gate assembly, in a parallel spaced apart arrangement, and (b) providing a reinforcing bracket for attaching to said gussets and to one of said end walls of said gate assembly, and attaching said lower cylinder mounting bracket to the reinforcing bracket, proximate the midpoint of said reinforcing bracket.

8. The method defined in claim 7, wherein each said upper cylinder mounting bracket is provided for mounting parallel to and proximate the upper edge of each of the plate-like doors.

9. The method defined in claim 8, wherein one of said upper cylinder mounting brackets, one of said sliding plate-like doors, and one of said upper cylinder pivot pins include axes which are parallel.

10. In a hopper-type railway car having a gate assembly including a pair of spaced apart side walls connected by end walls, and having an inner and an outer plate-like door slidably carried in inner and outer door guides formed by portions of said side walls and said end walls of said gate assembly, an actuator, including:

a) an upper cylinder mounting bracket attached to each of said plate-like doors, b) an upper cylinder pivot pin carried by each of said upper cylinder mounting brackets, c) a lower cylinder mounting bracket attached to said gate assembly proximate the lower end of one of the end walls, d) a pair of symmetrically spaced lower cylinder pivot pins mounted to said lower cylinder mounting bracket, and e) a pair of pressure fluid actuated cylinders connected one each between said upper cylinder pivot pins and said lower cylinder pivot pins.

11. The invention defined in claim 10, and further including:

a) a pair of gussets attached to said gate assembly in a parallel spaced apart arrangement; and b) a reinforcing bracket attached to said gussets and to an end wall of said gate assembly, said lower cylinder mounting bracket being attached to the reinforcing bracket proximate the midpoint thereof.

12. The invention defined in claim 11, wherein said upper cylinder mounting bracket is attached parallel to and proximate the upper edge of each of the plate-like doors.

13. The invention defined in claim 12, wherein the axes of said upper cylinder mounting bracket, said sliding plate-like door, and said upper cylinder pivot pins are parallel.

14. A hopper-type railroad car having at least one gate assembly including spaced apart side walls and end walls, an inner and an outer plate-like door slidably carried in inner and outer door guides formed by portions of the side walls and the end walls of the gate assembly, an actuator, including:

a) a first mounting bracket attached to each of the plate-like doors, b) a second mounting bracket attached to an end wall of the gate assembly, c) a pressure fluid actuated motor connected between said first and said second mounting brackets for effecting selective movement of said doors.

15. The invention defined in claim 14, and further including:

a) a pair of gussets attached to said gate assembly in a parallel spaced apart arrangement; and b) a reinforcing bracket attached to said gussets and to an end wall of said gate assembly, said second mounting bracket being attached to the reinforcing bracket proximate the midpoint thereof.

16. The invention defined in claim 15, wherein said first mounting bracket is attached parallel to and proximate the upper edge of each of the plate-like doors.

* * * * *